US008164405B2

(12) United States Patent
Hsu et al.

(10) Patent No.: US 8,164,405 B2
(45) Date of Patent: Apr. 24, 2012

(54) LOW-PROFILE MULTI-DIRECTIONAL KEY SWITCH STRUCTURE

(75) Inventors: Chien-Yu Hsu, Taoyuan Hsien (TW); Hua-Chun Chang, Taoyuan Hsien (TW)

(73) Assignee: Speed Tech Corp., Taoyuan Hsien (TW)

( * ) Notice: Subject to any disclaimer, the term of this patent is extended or adjusted under 35 U.S.C. 154(b) by 193 days.

(21) Appl. No.: 12/576,588

(22) Filed: Oct. 9, 2009

(65) Prior Publication Data

US 2010/0314230 A1 Dec. 16, 2010

(30) Foreign Application Priority Data

Jun. 10, 2009 (TW) ..... 98210370 U

(51) Int. Cl.
*H01H 9/00* (2006.01)

(52) U.S. Cl. ..... 335/205

(58) Field of Classification Search ..... 335/205–207; 200/5 A, 6 R, 4, 151, 302.1, 302.3, 512; 345/156, 345/157, 160, 161, 163
See application file for complete search history.

(56) References Cited

U.S. PATENT DOCUMENTS 5,504,502 A * 4/1996 Arita et al. ..... 345/160
6,266,046 B1 * 7/2001 Arita ..... 345/156
6,525,277 B2 * 2/2003 Oba et al. ..... 200/4
6,670,563 B1 * 12/2003 Jeon ..... 200/11 R
6,760,006 B2 * 7/2004 Arita et al. ..... 345/156
6,897,391 B2 * 5/2005 Gavalda ..... 200/512
6,974,920 B2 * 12/2005 Yu ..... 200/6 A
7,135,646 B2 * 11/2006 Tan ..... 200/4
7,348,512 B2 3/2008 Iohara
2005/0068134 A1 * 3/2005 Nishino et al. ..... 335/207
2008/0048649 A1 2/2008 Choi et al.

* cited by examiner

*Primary Examiner* — Bernard Rojas
(74) *Attorney, Agent, or Firm* — Muncy, Geissler, Olds & Lowe, PLLC

(57) ABSTRACT

A low-profile multi-directional key switch structure is disclosed, which includes a magnetic element, a key cap for receiving at least a portion of the magnetic element therein, an elastic element centered near the key cap, and a protection pad disposed between the extension portion of the key cap and the elastic element. The key cap has an extension portion protruding outwardly. The elastic element includes a central region and a spiral structure connected with the central region. The spiral structure is extended from the central region outwardly, and the elastic element is centered near the key cap by the central region for limiting a movement of the key cap and the magnetic element to an original location of the elastic element. The protection pad covers a most portion of the spiral structure of the elastic element, and a receiving opening is disposed in a center of the protection pad for passing the magnetic element through.

8 Claims, 7 Drawing Sheets

LOW-PROFILE MULTI-DIRECTIONAL KEY SWITCH STRUCTURE

RELATED APPLICATIONS

The present application is based on, and claims priority from, Taiwan Application Serial Number 98210370, filed Jun. 10, 2009, the disclosure of which is hereby incorporated by reference herein in its entirety.

FIELD OF THE INVENTION

This invention relates generally to a low-profile multidirectional key switch structure, and more particularly, to a low-profile multidirectional key switch structure adopted in a mobile communication device, for generating various instructions by a single key.

BACKGROUND OF THE INVENTION

A multi-directional key switch is very popular currently, and it is applied widely in cars, mobile phones, notebook computers, music players and other household appliances. The multi-directional key switch generally presents a cursor on a screen, and it has functions similar to a mouse or track ball used in a computer.

U.S. Pat. No. 7,348,512 discloses a multi-directional key switch adopted in a mobile phone, which has a plurality of dome switches disposed beneath the key cap. When a user presses the key cap along some direction of the key cap, the dome switch closest to the pressing point may be turned on, the circuit of the circuit board generates a signal, and then the system appropriately responds pursuant to the signal.

Reference is made to FIG. 11, which discloses a thin input device in the U.S. Patent Application Publication No. 2008/0048649. The thin input device includes an assembly of a housing A, a key cap (manipulation element) B, a magnetic element C, an elastic element D and a displacement detection means F. The total assembly can be directly fixed on or detached from a circuit board G of the mobile terminal. The key cap B can move along any direction. The magnetic element C is disposed inside the key cap B. The displacement detection means F can be electrically connected to an external electrical device. A plurality of Hall sensors are configured in the displacement detection means F, for detecting the movement of the key cap B. The housing A can be directly fixed on or detached from the circuit board G and detachably covers the key cap B. The elastic element D is disposed on the circuit board beneath the key cap B. On the other hand, the elastic element D is substantially fixed on the circuit board G through the housing A. The elastic element D is made of a soft material with excellent elasticity. When the key cap B moves, the elastic element D is deformed to generate a restoring force to pull the key cap B back to the original position.

In U.S. Patent Application Publication No. 2008/0048649, the key cap B moves towards some direction, the magnetic element C immediately moves along with the key cap B. Once the magnetic element C moves, the magnetic field will change in the peripheral space of the magnetic element C. The displacement detection means F can detect this magnetic changes, and then such information is transmitted to the circuit of the circuit board G, resulting that the mobile terminal system can appropriately respond pursuant to the displacement of the key cap B.

Since the elastic element D is formed by a soft material with excellent elasticity, and the weight of the elastic element D, the key cap B and the magnetic element C continuously puts on the elastic element D, so that such weight applies a preexisted downward pressure on the dome switch G1 of the circuit board G. Thus, the dome switch G1 of the circuit board G is easily and accidentally turned on, resulting in a wrong signal sending to the circuit board G. Accordingly, the design proposed by U.S. Patent Application Publication No. 2008/0048649 does not meet industrial demand.

SUMMARY OF THE INVENTION

Accordingly, it is an aspect of the present invention to provide a low-profile multi-directional key switch structure, thereby preventing reducing the probabilities of accidental mistakes about turning on the dome switch.

According to an embodiment of the present invention, a low-profile multi-directional key switch structure is disclosed, which includes a magnetic element, a key cap for receiving at least a portion of the magnetic element therein, an elastic element centered near the key cap, and a protection pad disposed between the extension portion of the key cap and the elastic element. The key cap has an extension portion protruding outwardly. The elastic element includes a central region and a spiral structure connected with the central region. The spiral structure is extended from the central region outwardly, and the elastic element is centered near the key cap by the central region for limiting a movement of the key cap and the magnetic element to an original location of the elastic element. The protection pad covers a most portion of the spiral structure of the elastic element, and a receiving opening is disposed in a center of the protection pad for passing the magnetic element through.

The spiral structure of the elastic element is extended from the central region outwardly and tends to be an involute curve. The elastic element has a spirally hollowed-carved space instead of being a completely substantial body. Since the spiral structure of the elastic element has a hollowed-carved space, the weight of the central region and pre-existed pressure on the dome switch of the circuit board can be alleviated, so as to reduce the probabilities of accidental mistakes about turning on the dome switch.

In the disclosed structure, the key cap and the magnetic element of the invention continuously applies their weight on the elastic element as the prior structure does, however, the spiral structure of the elastic element can be adjusted in manners of loosening or tightening the involute curve, or changing the cross-sectional shape or size of the spiral structure, so that the spiral structure of the elastic element can effectively bear the weight of the key cap and the magnetic element.

When a user presses the key cap and makes it to shift away from the original position, the key cap can elastically return to the original position by the elastic restoring force, and thus the key cap may not be shifted away from the elastic center too much. As such for the elasticity of the elastic element provided by the spiral structure, the elastic center is generally close to the center of the outer shape. Therefore, the key cap is normally located near the center of the outer shape of the spiral structure, so as to keep the spiral structure to elastically return to the original position.

The key cap has an extension portion protruding outwardly, for at least covering the central region of the elastic element in the top view of the key switch structure, so as to prevent foreign bodies from accidentally dropping into the central region of the elastic element. The protection pad is disposed between the extension portion of the key cap and the elastic element, for preventing interference between the extension portion of the key cap and the space of the spiral structure of the elastic element.

Other applications related with the prevent invention can be obvious due to the disclosure in the present invention. However, several preferred embodiments are exemplified in the present disclosure rather than limiting the applying scope thereof.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
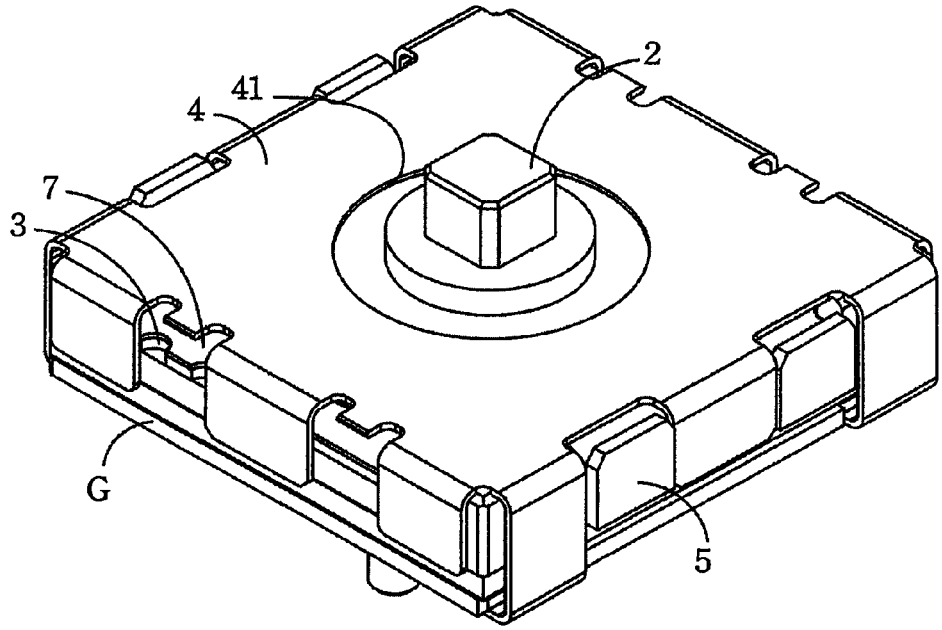
FIG. 1 depicts a three-dimensional perspective view of a low-profile multi-directional key switch structure from an upper view according to an embodiment of the present invention.
Figure 2:
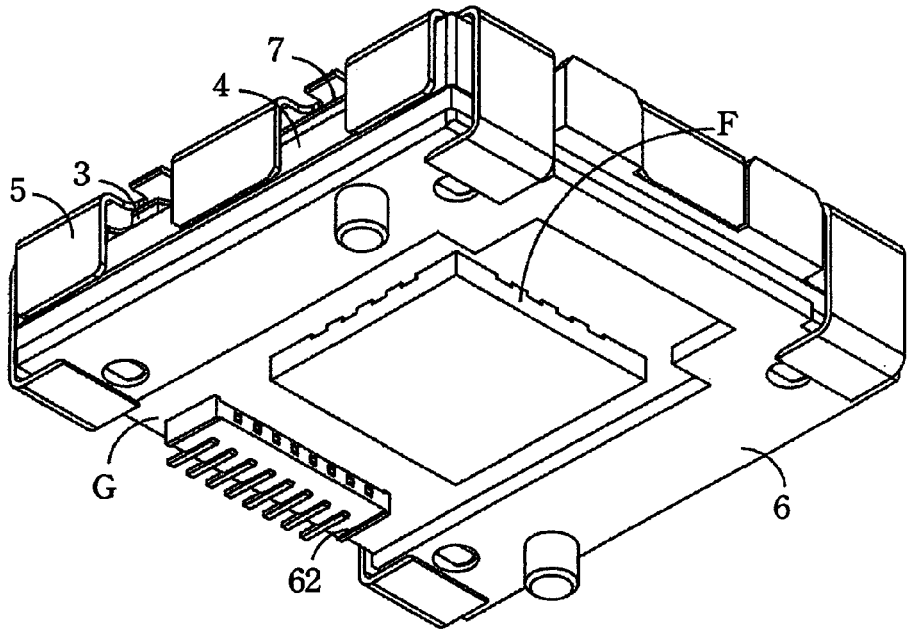
FIG. 2 depicts a three-dimensional perspective view of a low-profile multi-directional key switch structure from a lower view according to an embodiment of the present invention.
Figure 3:
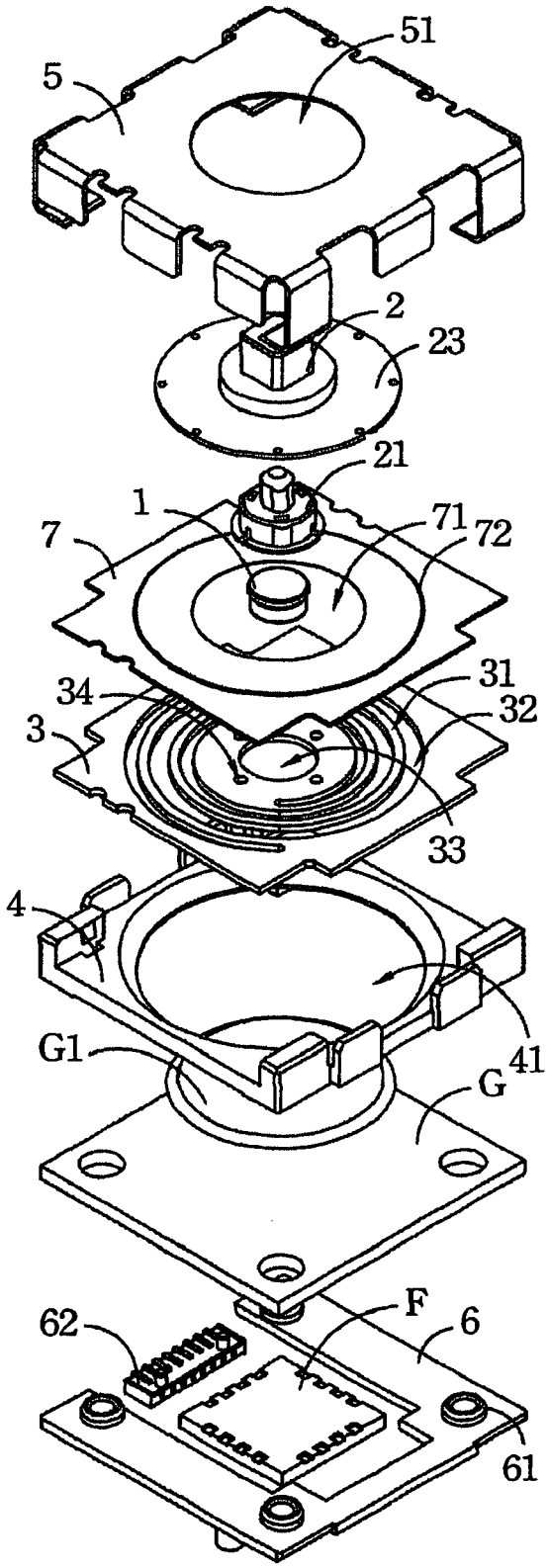
FIG. 3 depicts an exploded view of the low-profile multi-directional key switch structure of FIG. 1.
Figure 4:
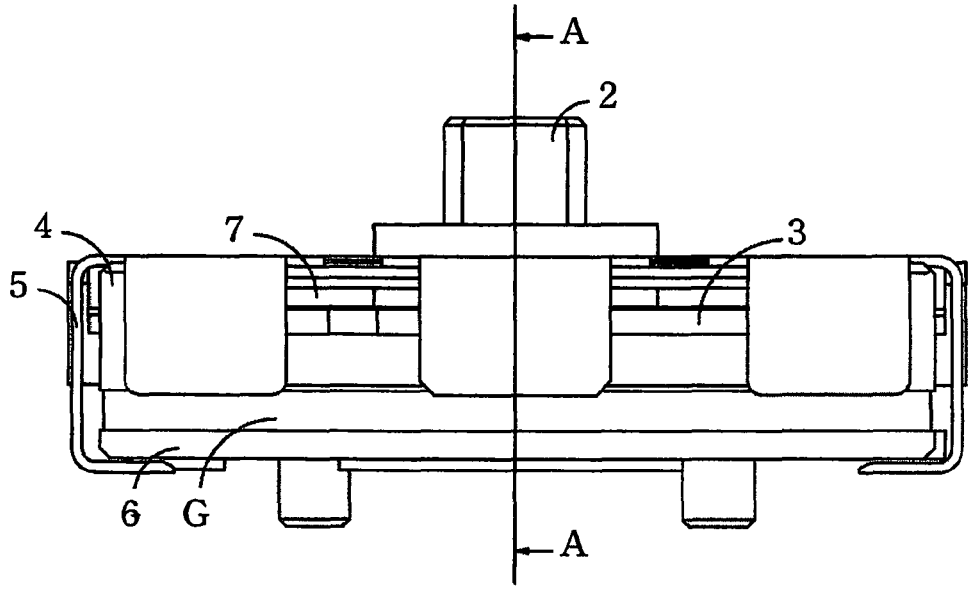
FIG. 4 depicts a front view of the low-profile multi-directional key switch structure of FIG. 1.

Reference is made to FIGS. 1-5, which depict various views of a low-profile multi-directional key switch structure according to an embodiment of the present invention. The low-profile multi-directional key switch structure is disposed on a surface of a circuit board G, as shown in FIG. 1. The surface of the circuit board G has at least a dome switch G1 thereon, as shown in FIG. 3. The other surface of the circuit board G has a motion detection device F as shown in FIG. 2, so as to detect a user's operation of the multi-directional key switch.

In an embodiment of the present invention, the low-profile multi-directional key switch may include a magnetic element 1, a key cap 2 for receiving at least a portion of the magnetic element 1 therein, and an elastic element 3 centered near the key cap 2, as shown in FIG. 3. In general, the magnetic element 1 may have another portion protruding from the key cap 2, and the portion is freely passed through and accommodated in a central region of the elastic element 3. The elastic element 5 surrounds an outside of the magnetic element 1.

The magnetic element 1 can generate a magnetic field in a space for a long term, and the motion detection device F disposed on the circuit board G can detect the magnetic field generated by the magnetic element 1. When the movement of the magnetic element 1 causes change of the magnetic field in a space, the motion detection device F disposed on the circuit board G can also detect such magnetic change.

Figure 5:
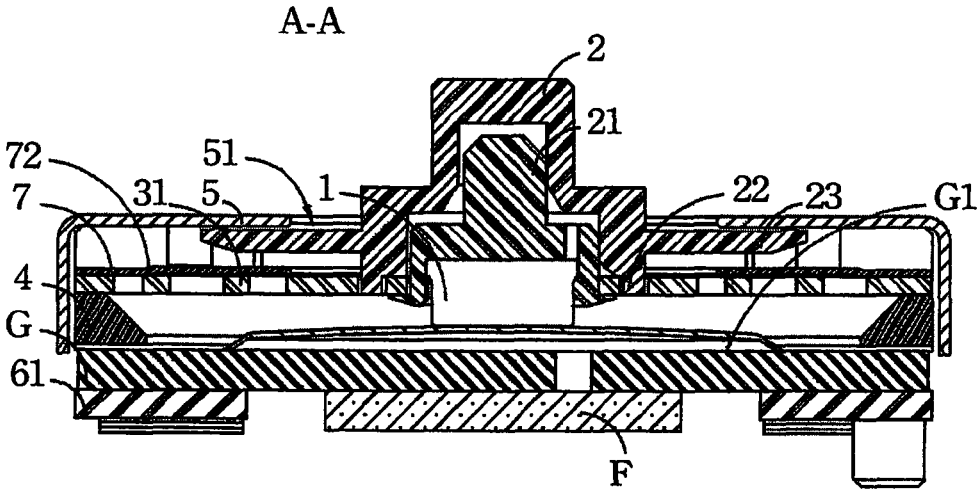
FIG. 5 depicts a cross-sectional diagram of the low-profile multi-directional key switch structure of FIG. 4 along the line A-A.
Figure 6:
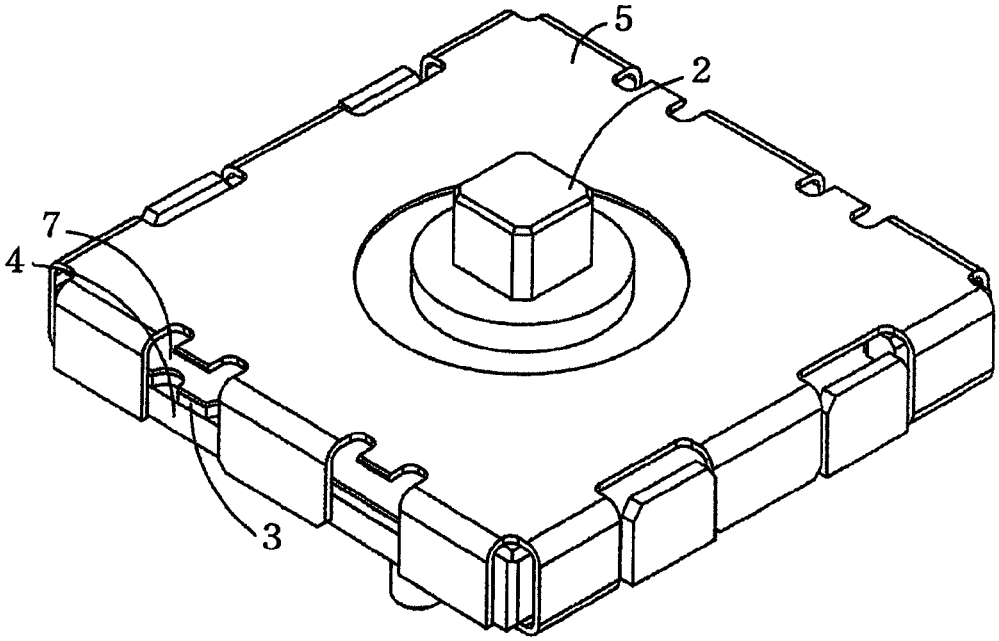
FIG. 6 depicts a three-dimensional perspective view of a low-profile multi-directional key switch structure from an upper view according to another embodiment of the present invention.
Figure 7:
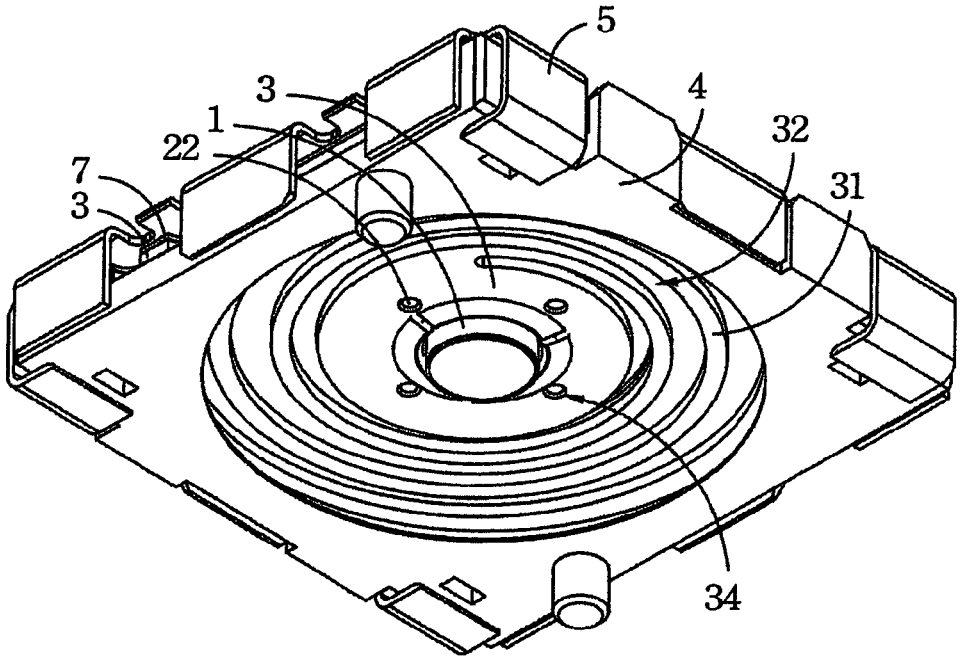
FIG. 7 depicts a three-dimensional perspective view of a low-profile multi-directional key switch structure from a lower view according to another embodiment of the present invention.

The key cap 2 may have a liner 21 separately assembled to the key cap 2, as shown in FIG. 5. The liner 21 can be intervened between the key cap 2 and the magnetic element 1, for keeping the key cap 2 to carry the magnetic element 1. The key cap 2 further includes a plurality of guiding columns 22 extending towards the elastic element 3. The elastic element 3 has a plurality of position holes 34 corresponding to the guiding columns 22, so that the key cap 2 moves restrictedly within an admittable deformation range of the elastic element 3. The elastic element 3 further has an involutely spiral structure 31 for providing the elastic element 3 with appropriate elasticity. In other words, the elastic element 3 has a spirally involute space 32 defined in the spiral structure 31, thereby permitting the elastic element 3 to deform elastically, and reducing a weight of the elastic element 3.

In the low-profile multi-directional key switch structure according to an embodiment of the present invention, the elastic element 3 may be supported by a base 4, in which the base 4 is fixed on the circuit board G, so as to separate the elastic element 3 and the base 4 by a distance that is at least identical to height of the dome switch G1. In this embodiment, the spiral structure 31 of the elastic element 3 can be adjusted in manners of changing the cross-sectional shape or size of the spiral structure 31, for effectively reducing deformation degree of the elastic element 3 along the vertical direction to the circuit board G, so as to reduce the probabilities of accidental mistakes about turning on the dome switch G1 on the circuit board G.

The elastic element 3 has a central hole 33 that is no less than the minimum of the outer shape of the magnetic element 1, so that at least a portion of the magnetic element 1 can pass through the central hole 33. A through hole 41 is disposed in a central region of the base 4 corresponding to the central hole 33 of the elastic element 3, and the through hole 41 has a size no less than the minimum of the outer shape of the magnetic element 1, too. The magnetic element 1 can be closer to the circuit board G by passing through the central hole 33 of the elastic element 3 and the through hole 41 of the base 4, thereby reducing the total height of the low-profile multi-directional key switch structure.

In this embodiment, the low-profile multi-directional key switch structure may further have a housing 5 that substantially restricts the relative position of the key cap 2, the elastic element 3, the base 4 and the circuit board G. The key cap 2 has an extension portion 23 protruding outwardly, for surrounding the magnetic element 1 and at least covering the central hole 33 of the elastic element 3 in the top view of the key switch structure. The housing 5 has an opening 51 with a size between the key cap 2 and its extension portion 23, so that the opening 51 of the housing 5 has enough space for passing the key cap 2 through. Additionally, the opening 51 of the housing 5 can restrict a user to manipulate the key cap 2 of the low-profile multi-directional key switch within a specific range of the diameter of the opening 51, and the housing 5 and the extension portion 23 of the key cap 2 can prevent foreign bodies from accidentally dropping into the key switch.

In this embodiment, a protection pad 7 is disposed between the extension portion 23 of the key cap 2 and the elastic element 3. The protection pad 7 has a receiving opening 71 disposed in a center of the protection pad 7, and the receiving opening 71 has a larger diameter than the liner 21 of the key cap 2, for passing the liner 21 through the receiving opening 71. The protection pad 7 may be made of a sheet with excellent mechanical rigidity or made of a soft material with toughness, for preventing interference between the extension portion 23 of the key cap 2 and the spirally involute space 32 of the elastic element 3 during a user manipulates and moves the key cap 2. Since the protection pad 7 has the function for preventing interference between the extension portion 23 of the key cap 2 and the spirally involute space 32 of the elastic element 3, the protection pad 7 covers a most portion of the spiral structure 31 of the elastic element 3.

In this embodiment, a lifted layer 72 is disposed between an outer edge and the receiving opening 71 of the protection pad 7, so that the distance between the protection pad 7 and the elastic element 3 is different from the one between the edge of the receiving opening 71 of the protection pad 7 and the elastic element 3. Hence, the protection pad 7 can increase the distance between the extension portion 23 of the key cap 2 and the elastic element 3 rather than increasing the material thickness. In an example, when the protection pad 7 is made of a sheet of excellent mechanical rigidity, the movement of the magnetic element 1 in the liner 21 of the key cap 2 can be restricted indirectly in a limited range by adjusting the diameter of the receiving opening 71.

The opening 51 of the housing defines the moveable region of the magnetic element 1, for example, by defining both with the identical diameter. In an example, when the protection pad 7 is made of the soft material with toughness, the lightweight protection pad 7 can be easily assembled with the elastic element 3 by adhesion.

According to an embodiment, the low-profile multi-directional key switch structure may be installed in an electrical device as a module design. With respect to the electrical device, the circuit board G of this embodiment may be a simple and small circuit board, and the motion detection device F may be disposed on a surface of the circuit board G opposing to the base 4. A supporting frame 6, which surrounds and protects the motion detection device F, has a plurality of protrusions 61 for positioning the supporting frame 6 at an appropriate location. In order to provide communication between the circuit board G of this embodiment and the electrical device, a connector 62 may be further disposed near the supporting frame 6, so that the circuit board G can transmit the motion information of the key cap 2 to the electrical device.

Reference is made to FIGS. 6-10, which depict various views of a low-profile multi-directional key switch structure equipped to a circuit board (unshown) of an electrical device according to another embodiment of the present invention. It is noted that, the circuit board is simply represented herein but may have many electrical circuit and components configured thereon.

Figure 8:
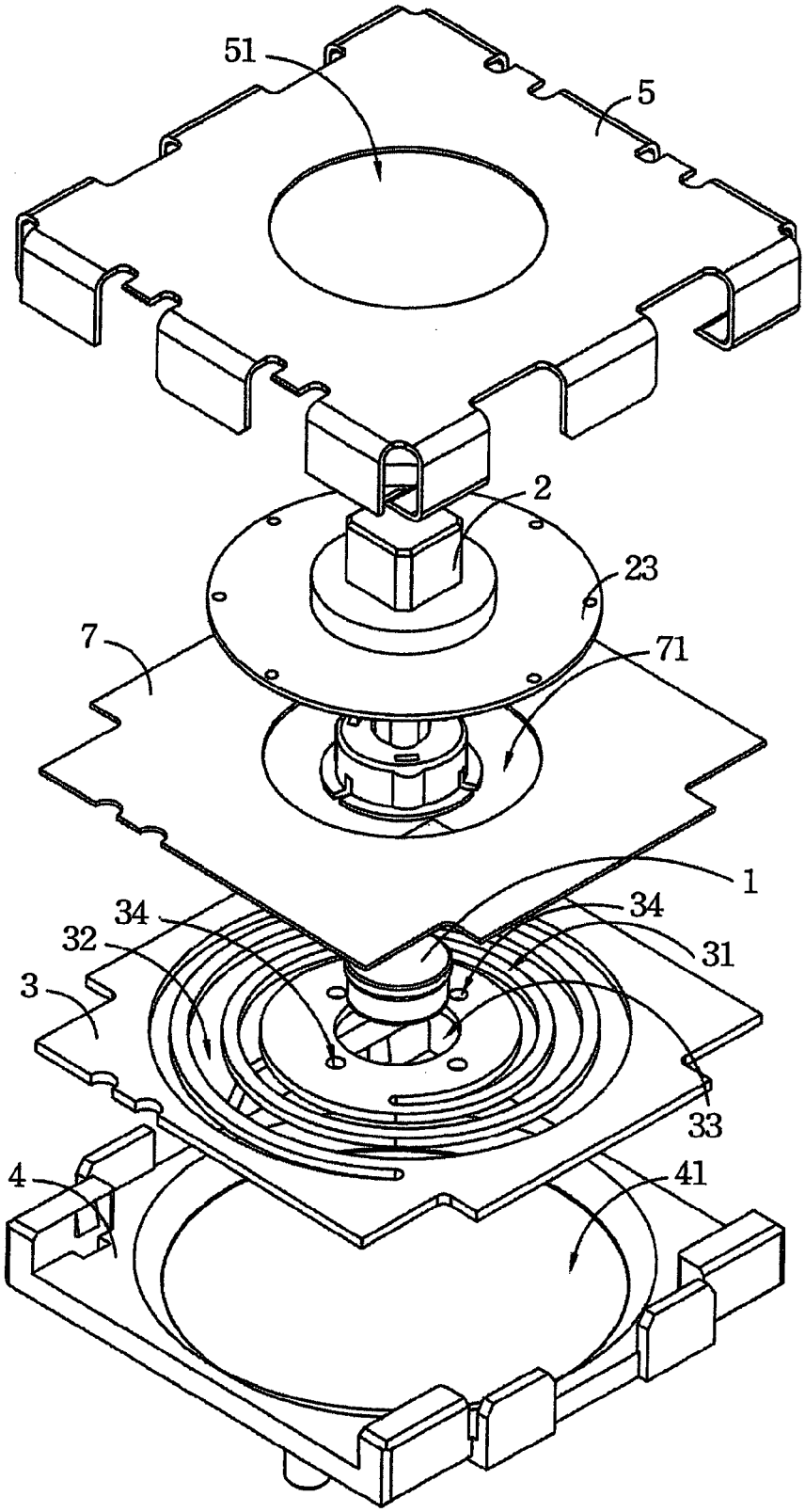
FIG. 8 depicts an exploded view of the low-profile multi-directional key switch structure of FIG. 6.
Figure 9:
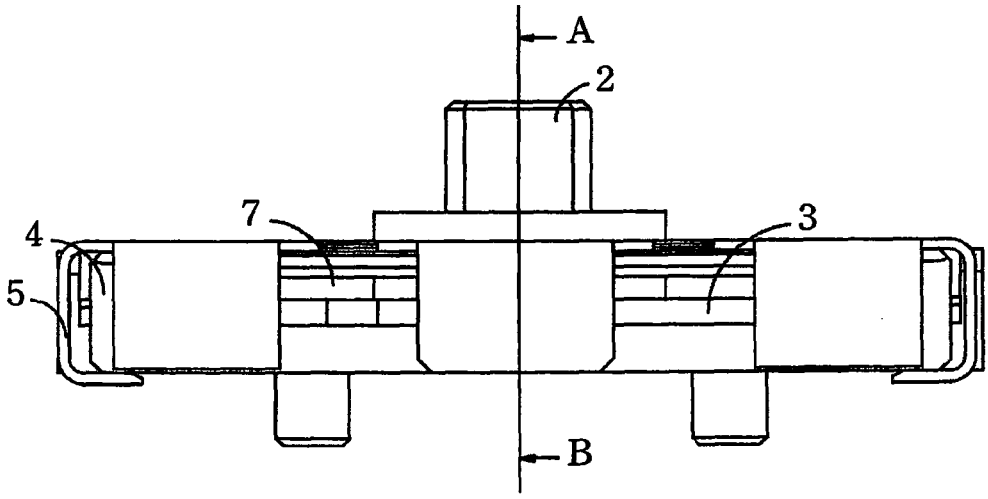
FIG. 9 depicts a front view of the low-profile multi-directional key switch structure of FIG. 6.

In this embodiment, the low-profile multi-directional key switch may include a magnetic element 1, a key cap 2 for fixing the magnetic element 1 therein, and an elastic element 3 for receiving a portion of the magnetic element 1 that protrudes from the key cap 2 in a center of the elastic element 3, as shown in FIG. 8.

Figure 10:
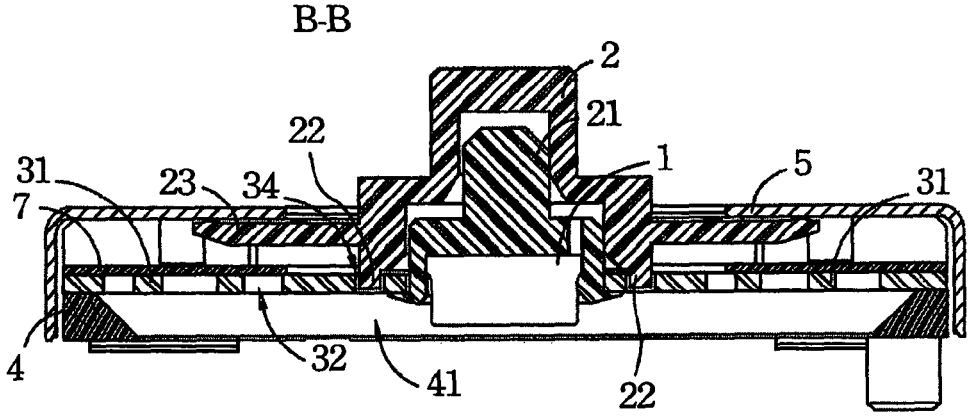
FIG. 10 depicts a cross-sectional diagram of the low-profile multi-directional key switch structure of FIG. 9 along the line B-B.
Figure 11:
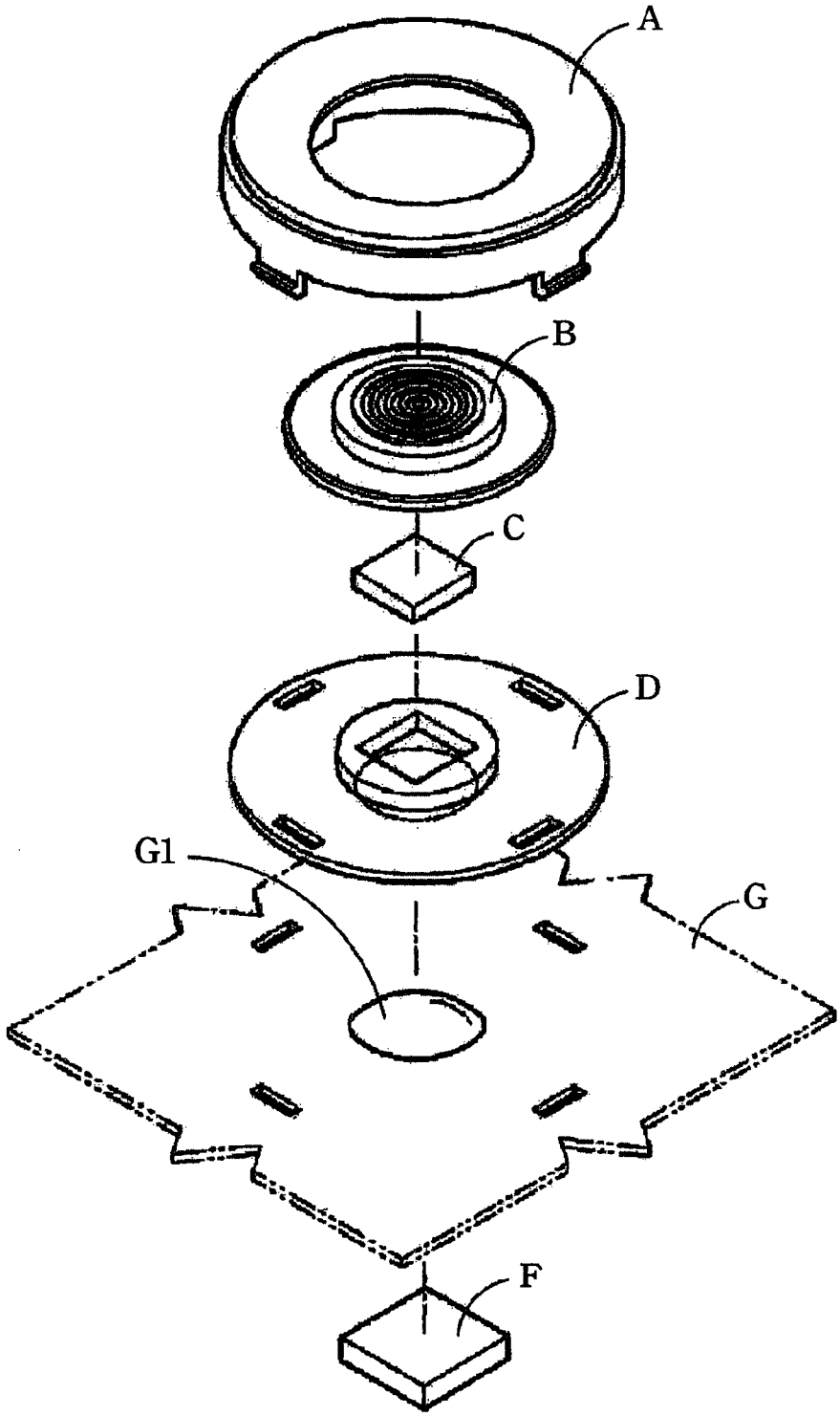
FIG. 11 depicts a schematic exploded perspective view showing a thin input device according to a preferred embodiment of U.S. Patent Application Publication No. 2008/0048649 A1.

The key cap 2 may have a liner 21 that is separately assembled to the key cap 2 and fixes the magnetic element 1, as shown in FIG. 10. The key cap 2 further includes a plurality of guiding columns 22 extending towards the elastic element 3, so that the key cap 2 is fixed in the position corresponding to the central hole 33 of the elastic element 3, and the movable range of the key cap 2 is restricted.

The elastic element 3 further has an involutely spiral structure 31. Since the spiral structure 31 of the elastic element 3 has a spirally involute space 32, thereby reducing a weight of the elastic element 3. The elastic element 3 may be fixed on a base 4, in which the base 4 is fixed on the circuit board.

In this embodiment, the low-profile multi-directional key switch structure may further have a housing 5 that substantially restricts the relative position of the key cap 2, the elastic element 3, the base 4 and the circuit board G. The key cap 2 has an extension portion 23 protruding outwardly. The housing 5 has an opening 51 with a diameter between the key cap 2 and its extension portion 23, so that the opening 51 of the housing 5 has enough space for passing the key cap 2 through. Additionally, the opening 51 of the housing 5 can restrict a user to manipulate the key cap 2 of the low-profile multi-directional key switch within a range of the diameter of the opening 51.

In this embodiment, a protection pad 7 is disposed between the extension portion 23 of the key cap 2 and the elastic element 3, and the protection pad 7 has a receiving opening 71 with a larger diameter than the liner 21 of the key cap 2, for passing the liner 21 through the receiving opening 71, for preventing interference between the extension portion 23 of the key cap 2 and the spirally involute space 32 of the elastic element 3.

In this embodiment, the protection pad 7 may be made of a plastic sheet, and the liner 21 of the key cap 2 is made of a material that is the same with the protection pad 7 or has similar mechanical properties to the protection pad 7, thereby preventing from serious degradation due to the very different mechanical properties.

It is worth mentioning that, the low-profile multi-directional key switch structure of the former embodiment can be additionally equipped in the electrical device, but the one of the later embodiment is directly installed in the electrical device. Moreover, the low-profile multi-directional key switch structure of the later embodiment is configured on the circuit board of the electrical device, in which the circuit board has the plurality of the electrical components disposed thereon.

As is understood by a person skilled in the art, the foregoing embodiments of the present invention are illustrated of the present invention rather than limiting of the present invention. It is intended to cover various modifications and similar arrangements included within the spirit and scope of the appended claims. Therefore, the scope of which should be accorded to the broadest interpretation so as to encompass all such modifications and similar structure.

What is claimed is:

1. A low-profile multi-directional key switch structure, comprising:

a magnetic element;

a key cap for receiving at least a portion of the magnetic element therein, wherein the key cap has an extension portion protruding outwardly and surrounding around the magnetic element;

an elastic element centered near the key cap, wherein the elastic element includes a central region and a spiral structure connected with the central region, the spiral structure is extended from the central region outwardly, and the elastic element is centered near the key cap by the central region for limiting a movement of the key cap and the magnetic element to an original location of elastic element; and a protection pad disposed between the extension portion of the key cap and the elastic element, wherein the protection pad is a sheet covering a majority of the spiral structure of the elastic element, and a receiving opening is disposed in a center of the protection pad for passing the magnetic element through.

2. The low-profile multi-directional key switch structure according to claim 1, wherein the movement of the magnetic element is limited by the receiving opening of the protection pad.

3. The low-profile multi-directional key switch structure according to claim 1, further comprising:

a lifted layer disposed between an outer edge and the receiving opening of the protection pad, thereby separating the protection pad from the elastic element by a first distance.

4. The low-profile multi-directional key switch structure according to claim 1, further comprising:

a base for disposing the elastic element thereon, wherein the elastic element is lifted up with a second distance by the base.

5. The low-profile multi-directional key switch structure according to claim 1, further comprising:

a housing for substantially covering the low-profile multi-directional key switch structure and limiting relative positions among the magnetic element, the key cap, the elastic element and the protection pad.

6. The low-profile multi-directional key switch structure according to claim 2, wherein the protection pad is made of an insulating plastic material.

7. The low-profile multi-directional key switch structure according to claim 2, wherein the receiving opening of the protection pad has a circular shape having a diameter between an outer diameter of the magnetic element and an outer edge of the extension portion.

8. The low-profile multi-directional key switch structure according to claim 4, wherein the base is disposed on a circuit board.

* * * * *